United States Patent [19]

Palme et al.

[11] 4,074,382

[45] Feb. 21, 1978

[54] HEATING APPARATUS FOR BOOK FORMING AND CREASING IRONS

[75] Inventors: Anthony Ferdinand Palme, Avon; Daniel Inott Streeter, Glastonbury, both of Conn.

[73] Assignee: The Smyth Manufacturing Company, Bloomfield, Conn.

[21] Appl. No.: 727,433

[22] Filed: Sept. 28, 1976

[51] Int. Cl.[2] ..... B42C 19/00

[52] U.S. Cl. ..... 11/1 CP

[58] Field of Search ..... 11/1 CP, 1 R, 1 AD

[56] References Cited

U.S. PATENT DOCUMENTS

| | | | |
|---|---|---|---|
| 2,151,957 | 3/1939 | Davis | 11/1 CD |
| 2,755,491 | 7/1956 | Terzuoli et al. | 11/1 CD |
| 3,123,848 | 3/1964 | Smith Jr. et al. | 11/1 CD |
| 3,438,075 | 4/1969 | Thorp | 11/1 CD |

*Primary Examiner*—Stephen C. Pellegrino
*Attorney, Agent, or Firm*—Prutzman, Hayes, Kalb & Chilton

[57] ABSTRACT

A book forming and pressing apparatus provides a pair of chain driven conveyors or carriages in side-by-side relation which define a book flow path between the carriages on which are mounted a plurality of creasing iron assemblies. The creasing iron assemblies move through the book flow path in synchronized timed relation to the passage of books with a book pressed between each pair of creasing iron assemblies. An array of fixed elongated lamps are provided on a return side of each carriage for emitting radiant energy in a line focused on a path of travel of nippers of the creasing iron assemblies to heat and maintain the nippers at an elevated temperature for creasing each book at its hinge area upon the nipper being conveyed by its carriage into the book flow path.

7 Claims, 2 Drawing Figures

HEATING APPARATUS FOR BOOK FORMING AND CREASING IRONS

FIELD OF THE INVENTION

This invention relates to book making machines and specifically concerns book forming and pressing apparatus.

BACKGROUND OF THE INVENTION

Book forming and pressing apparatus commonly use creasing irons, called nippers, to crease a book in its hinge area. In addition to pressure, heat is also used to assist in forming the book covering material and heating the adhesive within the book. Conventional nippers are heated by the use of an individual electrical resistance cartridge heater mounted within each creasing iron assembly to indirectly heat its nipper by conduction.

The creasing iron assemblies are normally mounted on a carriage transported by a continuously moving endless conveyor chain with the creasing iron assemblies in predetermined uniformly spaced relation to one another. An adjacent carriage, movable in an opposite angular direction, is provided with corresponding creasing iron assemblies, and matching creasing iron assemblies are transported by their respective carriages into opposed spaced confronting relation to one another in timed relation to the passage of a book along a feed path between the carriages. Each corresponding pair of creasing iron assemblies are thus driven in synchronism with one another and engage one of an oncoming stream of books to form a desired crease on both sides of each book in its hinge area.

Carbon copper contamination is prevelant in such conventional machines and is discharged from electrical brushes supported in trollies which ride along charged feed rails to provide the required electrical energy for heating the individual cartridge heater within each creasing iron assembly. Moreover, conventional machines normally have exposed bearings which provide for spray mist lubrication. The undesired contamination has been found to reduce the lubricant life and to cause bearing assemblies to wear more rapidly in addition to promoting undesired electrical arcing. Also, failure of a cartridge in any one creasing iron assembly will result in the book production with poor quality creases. Under normally high production speeds, a number of books of poor quality are normally produced before such failure is detected, and then the machine must be shut down and the required repair results in further loss of production time.

OBJECTS OF THE INVENTION

A primary object of this invention is to provide a new and improved book forming apparatus which produces a readily controlled, uniform heat directly delivered to the book engaging surfaces of continuously moving nippers.

Another object of this invention is to provide an apparatus of the type described which is particularly designed to minimize operational failures and to minimize the production of poor quality rejectable books commonly associated with conventional machines as well as for ensuring quick and easy detection of nipper heating failures.

A further object of this invention is to provide such a new and improved apparatus which facilitates mounting of a nipper in its assembly, which facilitates changing the nippers when desired, which eliminates the danger of electrical arcing resulting from carbon copper contamination from electrical brushes of conventional bus bars and which reduces bearing wear and prolongs lubrication life.

A yet further object of this invention is to provide a new and improved apparatus of the type described which significantly minimizes down time required to replace conventional nipper heaters and bearings.

Other objects will be in part obvious and in part pointed out more in detail hereinafter.

SUMMARY OF THE INVENTION

A book forming and pressing apparatus in provided with a pair of endless loop conveyors or carriages on which are mounted creasing iron assemblies with the carriages having working sides in spaced opposed relation to one another defining a book feed path. Each carriage has a return side and a fixed array of heating units mounted on the return side of each carriage just upstream of its working side for delivering high density radiant heating energy at focused locations coincident with the path of travel of nippers carried by the creasing iron assemblies for heating and maintaining the nippers at an elevated operating temperature level for subsequently engaging a hinge area of a book pressed between the working sides of the carriages.

A better understanding of this invention will be obtained from the following detailed description and the accompanying drawings of an illustrative application of the invention.

DETAILED DESCRIPTION OF A PREFERRED EMBODIMENT

Figure 1:
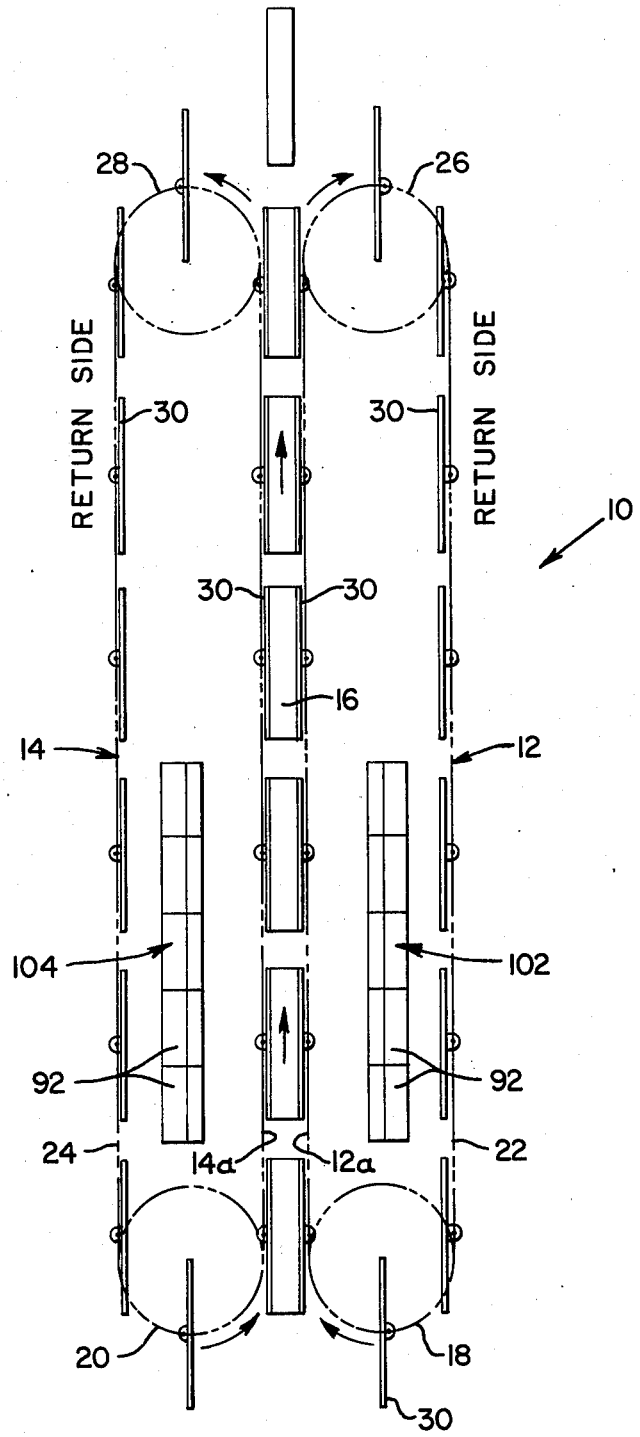
FIG. 1 is a schematic plan view illustrating a book forming apparatus wherein books are transported along a feed path by spaced opposed pairs of creasing iron assemblies mounted on continuously moving carriages.

Referring now to the drawings in detail, a schematic illustration of a book forming and pressing apparatus 10 of this invention is shown in FIG. 1. A pair of endless loop conveyors or carriages 12 and 14 are illustrated in side-by-side relation to one another with the carriages having working sides **12*a*, 14*a* spaced apart and confronting one another to define a feed path for a stream of oncoming books such a shown at 16. A book is shown at an entrance of the apparatus 10 between a pair of idler sprockets 18, 20 each of which will be understood to be in meshing engagement with a conventional endless roller chain drive 22, 24. The roller chain drive for each carriage 12, 14 is trained around downstream power operated drive sprockets 26, 28 with the working sides 12*a*, 14*a* of the carriages 12, 14 having confronting creasing iron assemblies 30, 30. The latter are driven at a uniform speed in a common direction along the book feed path in synchronism such that the confronting creasing iron assemblies 30, 30 receive and press a book 16 therebetween and convey it to a downstream exit end of the apparatus 10** for discharge.

Figure 2:
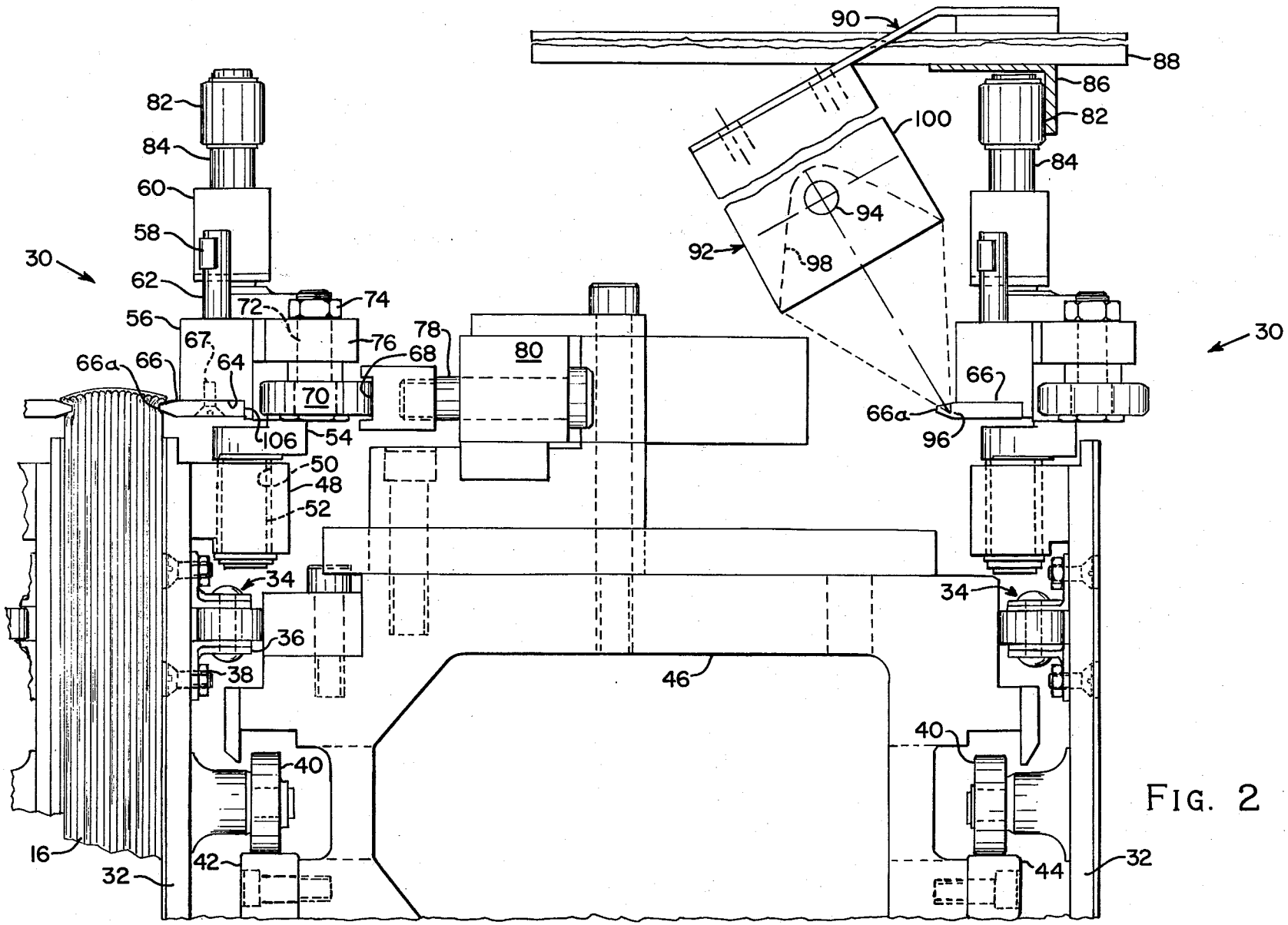
FIG. 2 is an enlarged fragmentary cross-sectional view, partly broken away and partly in section, showing portions of the right hand carriage of the apparatus of FIG. 1.

It is to be understood that each carriage 12, 14 comprises a series of vertically aligned slats 32 connected in parallel side-by-side relation in endless loop fashion by roller drive chain 34 the links 36 of which are secured by fasteners 38 to each slat 32. It will suffice for an understanding of this invention to describe only one of the carriages 12, 14 which are substantially identical expect for being in mirror image relation to one another and having their respective carriages being supported for movement about their sprockets in opposite angular directions. Turning now to carriage 12, best seen in FIG. 2, individual creasing iron assemblies 30 are shown conventionally mounted on slats 32 which are equally spaced apart. As best seen in FIG. 2, each creasing iron supporting slat 32 has a roller bearing 40 mounted on a horizontal axis extending from an intermediate portion of the slat for movement along horizontally extending supporting tracks 42, 44 fixed to opposite sides of casting assembly 46 which will be understood to be mounted on a frame, not shown, in a stationary position and which provides bearing support for the carriage 12. A similar arrangement is provided for carriage 14. The position of the castings 46 may be selectively adjusted laterally toward or away from the corresponding casting 46 on the other side of the book feed path thereby to adjustably position the slats 32 on the working sides **12*a*, 14*a* of carriages 12, 14 to establish desired side pressure on a book 16 received between the working side slats 32 of carriages 12 and 14**.

To permit the creasing iron assemblies 30 to be self-locating in a selected position relative to the feed path of the books 16 on the working side **12*a*, 14*a* of each carriage 12, 14, a mounting block 48 is integrally secured adjacent the top of each creasing iron supporting slat 32, and a vertically extending bore 50 is formed within block 48 for receiving a pivot pin 52 depending from its respective creasing iron assembly 30. Each creasing iron assembly 30 accordingly follows the movement of its slat 32 while being supported thereon for independent swiveling or rotation relative to the slat 32. The pivot pin 52 projects downwardly from a pivot lug 54 of C-shaped cross section on which a nipper supporting bar 56 is suitably connected for limited movement in a horizontal plane against the biasing force of a pair of restraining springs (only one shown at 58) attached to an overlying guide bar 60 supported on the pivot lug 54 with the springs 58 each engaging an upright pin such as at 62 fixed to the nipper supporting bar 56. Each creasing iron assembly 30 is provided with a nipper receiving recess 64 formed in the bottom of the nipper supporting bar 56. A creasing iron or nipper 66 may be secured in any suitable manner to its bar 56, such as by the illustrated threaded fastener 67 or a detent, not shown, to provide for quick and easy attachment and removal of the nipper 66 relative to its horizontal extending bar 56**.

To guide each creasing iron assembly 30 along the working side **12*a* of carriage 12, an elongated track 68 is shown secured in fixed horizontally disposed relation to casting 46, and a pair of suitable roller bearings such as the one shown at 70 are each supported for rotation about an upright pin 72 secured by a nut 74 to an offset extension 76 of the nipper supporting bar 56. By virtue of the above described construction, a desired depth of crease in the hinge area of the book 16 may be established by adjustment of the position of the nipper supporting bar 56 independently of its carriage 12. For this reason the track 68 is shown threadably engaged with plunger 78. The plunger itself is received within a locating device 80 which will be understood to be adjustably mounted on the casting 46 to selectively position the plunger 78 axially of its shank. Plunger adjustment establishes the position of the track 68 relative to the working side 12*a* of the carriage 12, and thereby establishes the position of the nipper 66 and the depth of crease, upon engagement of the roller bearings 70 of its resiliently mounted nipper supporting bar 56 with the track 68**.

To ensure that each creasing iron assembly 30 is maintained in upright position upon the carriage 12 being driven about its sprocket 26 to transport the creasing iron assembly 30 to the return side of carriage 12, suitable guide rolls such as illustrated at 82 are supported for rotation about a vertically extending axis provided by an upright post 84 secured to the upper guide bar 60 of each creasing iron assembly 30. As each creasing iron assembly 30 moves angularly away from the downstream exit end of the book feed path to the return side of the carriage 12, the guide rolls 82 engage an angle bracket illustrated at 86 as being fixed to an overhanging rail 88 which will be understood to be fixed to a frame, not shown, of the machine.

Accordingly, it will be seen that due to the guide rolls 86 and swivel mounting connection of each creasing iron assembly 30 relative to its supporting slat 32, movement of each supporting slat 32 about the periphery of the sprockets causes a following movement of its creasing iron assembly 30 which pivots within its mounting lug 48 such that the nipper 66 remains unchanged in its position relative to the feed path of the books 16. As each creasing iron assembly 30 is transported between the working and return sides of its carriage 12, its nipper 66 remains disposed on an in-board side of the pivot pin 52.

To deliver a uniform consistent heat directly to each nipper 66 without danger of producing books with poor quality creases, the apparatus of this invention provides a plurality of heating units which produce a high density radiant heat energy with the units being mounted in a fixed array such that the energy is focused on a working edge of each nipper. A suitable supporting bracket 90 is fixed in the illustrated embodiment to the overhanging rail 88 on the return side of each carriage 12, 14 adjacent sprockets 18, 20. In the specifically illustrated embodiment, the array of heating units are provided by a plurality of high density lamps 92, connected to a suitable source of electrical power, not shown, which are capable of emitting concentrated radiant heat in a focused condition to impinge on the edge of each nipper 66 before its transfer to the working side of its carriage. The lamps 92 may be high intensity line heaters having a high temperature (4000°–5400° F) tungsten filament emitter in an argon atmosphere enclosed within a clear quartz tube 94, and the radiant energy emitted is direct-imaged on an external focal line 96 by a highly polished aluminum elliptical reflector 98. Reflector 98 may be a two-dimensional elipse of the type shown in FIG. 2 mounted in a suitable enclosure 100 secured to its supporting bracket 90 and positioned over the creasing iron assemblies 30 on the return side of each carriage 12, 14 such that the radiant energy is focused directly on the book engaging edge **66*a* of each nipper 66 as it passes through its respective heating zone 102, 104 just upstream of the entrance to the working sides 12*a*, 14*a* of carriages 12, 14. An in-line series of such line heaters of the type described with, say a 2-inch focal projection have been found to work satisfactorily to maintain the temperature level of each of the nippers 66 as they pass under the focus line of the heaters at an operating temperature of about 350° F. As the creasing irons or nippers 66 emerge from their heating zones 102, 104 and are moved into operative position such as that illustrated on the working side 12***a* of carriage 12 in FIG. 2 to engage a book which is squeezed between the carriages 12, 14 along the feed path, the heated nipper 66 has been found to effectively transfer heat to the book and establish the desired indentation or crease at the hinge area as the book 16 and its creasing irons move in synchronism through the machine along the book feed path prior to discharge of the book 16 and the simultaneous movement of the creasing iron assemblies 30, 30 to the return sides of the machine. The temperature drop between the emergence of each nipper 66 from the heating zones 102, 104 and its return thereto has been found to be about 50° F. The described radiant energy heating apparatus has been found to satisfactorily restore the lost heat and maintain each nipper 66 at an effective operating temperature.

By virtue of the above described construction, the elongated individual nippers 66 are readily removable, e.g., to be reversely mounted such that their linearly extending book engaging edge 66*a* of tapered or knife-like cross section, which is used for a round back book, may be reversed into an inoperative position. The opposite wider flat edge 106 may then be disposed in an operative position projecting from its bar 56 for engaging, e.g., a flat back book to effect a similar creasing operation. In addition to providing such desired flexibility for nipper edge reversal in a quick and easy manner, the energy radiated from each bank of elongated line heater units 92 may be separately controlled by a conventional rheostat or solid state proportioning thermostat, not shown. Even if one of the lamps or line heaters 92 were to fail, the remaining heaters may be maintained in operative condition with the radiant heat at a controlled operating level to ensure that the requisite temperature is maintained on the nippers 66 passing along the focal line of the heating units 92. In this regard it will be seen that the focal line of the heaters 92 is substantially co-extensive with the path of travel of the nipper edges through their respective heating zones 102, 104 with the linearly extending elliptical reflectors 98 of the lamps 92 providing for focusing the radiant energy along the path of travel of the nipper edges through their heating zone. In the event of failure of, say, one of the lamps 92, the machine need not necessarily be shut down, but rather the radiant energy output of that array of lamps may be increased by its separate rheostat and continuous production of high quality books is assured. In addition, it has been found that significant book quality improvement and bearing and lubricant life improvements have been achieved with the use of the described heating apparatus. Moreover, the heat is delivered directly to the nipper working surface where it is used. Consequently, the remaining nipper assembly components are cooler which is also considered beneficial to bearing and lubricant life.

As will be apparent to persons skilled in the art, various modifications, adaptations and variations of the foregoing specific disclosure can be made without departing from the teachings of this invention.

We claim:

1. A book forming apparatus comprising first and second endless loop carriages, means supporting the carriages for continuous synchronized movement, the carriages each having a working side, a return side and a series of book hinge creasing iron means supported on each carriage, the working sides of the carriages defining a book flow path therebetween with the creasing iron means supported for movement by their respective carriages along their working sides being in parallel spaced confronting relation for receiving and transporting a book along said book flow path between each corresponding pair of creasing iron means, and first and second stationary heating means fixed in position for heating the creasing iron means of the carriages upon movement of said creasing iron means along their respective return side upstream of their respective working side for applying a hinge crease to a book with the assistance of heat each of said first and second heating means including a separate control means for selectively varying the energy produced and for heating the creasing iron means to a desired temperature prior to its passage into the book flow path.

2. The apparatus of claim 1 wherein the working and return sides of each carriage are parallel linear runs, wherein the creasing iron means each includes an elongated nipper having a linearly extending book engaging edge, and wherein the heating means comprises a heat source for producing radiant energy in a heating zone extending along at least a portion of the return side of said one carriage.

3. A book forming apparatus comprising first and second endless loop carriages, means supporting the carriages for continuous synchronized movement, the carriages each having a working side, a return side and a series of book hinge creasing iron means supported on each carriage, the working and return sides of each carriage being parallel linear runs, the working sides of the carriages defining a book flow path therebetween with the creasing iron means supported for movement by their respective carriages along their working sides being in parallel spaced confronting relation for receiving and transporting a book along said book flow path between each corresponding pair of creasing iron means, the creasing iron means each including an elongated nipper having a linearly extending book engaging edge, and a stationary heat source fixed in position for producing radiant energy in a heating zone extending along at least a portion of the return side of one carriage for heating the creasing iron means of said one carriage upon movement of its creasing iron means along its return side upstream of its working side for applying a hinge crease to a book with the assistance of heat, the heat source including focusing means for focusing the radiant energy along a focal line in said heating zone impinging on the path of travel of said edges of the nippers through said heating zone.

4. The apparatus of claim 3 wherein the heat source includes a linearly extending line heater tube, and wherein the focusing means comprises a linearly extending elliptical reflector for direct-imaging the radiant energy in highly concentrated heat flux density on said focal line.

5. The apparatus of claim 3 wherein said focal line is substantially co-extensive with the path of travel of said edges of the nippers through said heating zone.

6. The apparatus of claim 3 wherein the creasing iron means each includes a support member and an elongated nipper with opposite longitudinal sides and a linearly extending book engaging edge on each side, and wherein releasable mounting means are provided for detachably securing the nipper to its support member with one of said book engaging edges disposed in a projecting book engaging position for quick and easy removal and reverse mounting of the nipper relative to its support member.

7. The apparatus of claim 3 further including a second stationary heating means fixed in position for heating the creasing iron means of the other carriage upon movement of its creasing iron means along its return side upstream of its working side.

* * * * *